US008133090B2

(12) United States Patent
Hardin

(10) Patent No.: US 8,133,090 B2
(45) Date of Patent: Mar. 13, 2012

(54) DOLLS AND DOLL STANDS

(75) Inventor: Mark Hardin, Austin, TX (US)

(73) Assignee: Mattel, Inc., El Segundo, CA (US)

( * ) Notice: Subject to any disclaimer, the term of this patent is extended or adjusted under 35 U.S.C. 154(b) by 298 days.

(21) Appl. No.: 12/427,630

(22) Filed: Apr. 21, 2009

(65) Prior Publication Data

US 2009/0264045 A1 Oct. 22, 2009

Related U.S. Application Data

(60) Provisional application No. 61/125,081, filed on Apr. 21, 2008.

(51) Int. Cl.
*A63H 3/50* (2006.01)
*A63H 3/00* (2006.01)

(52) U.S. Cl. ..... 446/331; 446/268; 446/330; 428/24; 40/411

(58) Field of Classification Search ..... 446/330, 446/331, 268; 428/24; 40/411
See application file for complete search history.

(56) References Cited

U.S. PATENT DOCUMENTS 549,039 A * 10/1895 Wenger ..... 40/411
1,407,165 A 2/1922 Pajeau
1,601,983 A 10/1926 Savage
1,916,988 A * 7/1933 Pieschke ..... 40/412
2,155,665 A 4/1939 Leeper
2,280,467 A 4/1942 Blanc
2,380,175 A 7/1945 Hawkey
2,401,456 A 6/1946 Bresch
2,421,279 A 5/1947 Marty
2,453,646 A 11/1948 Tomlin et al.
2,692,988 A 11/1954 Rouse
2,990,668 A 7/1961 Brendel
3,471,964 A * 10/1969 Cherry et al. ..... 446/268
3,597,877 A * 8/1971 Speers ..... 446/72

(Continued)

FOREIGN PATENT DOCUMENTS

GB 2081111 2/1982

(Continued)

OTHER PUBLICATIONS

U.S. Receiving Office, International Preliminary Report on Patentability regarding Application No. PCT/US2009/041285, Nov. 4, 2010, 5 pages.

(Continued)

*Primary Examiner* — Gene Kim
*Assistant Examiner* — Alexander Niconovich
(74) *Attorney, Agent, or Firm* — Kolisch Hartwell, PC

(57) ABSTRACT

A toy product including a doll and a display device that may be used with the doll is disclosed. The doll may have one or more movable features and may be releasably coupled to the display device. The display device may include an actuating assembly and a folding assembly with enclosure pieces that may alternately enclose and reveal the doll within the display device. The assemblies may communicate with each other and with movable features of the doll through selectively actuable components. A locking member may engage and releasably retain the folding assembly in a retracted position and may return the folding assembly to an extended position upon disengagement. In the embodiments in which the enclosure pieces resemble flower petals, the movement of the enclosure pieces may have the effects of a flower bloom closing and opening up to respectively surround and reveal the doll.

21 Claims, 7 Drawing Sheets

U.S. PATENT DOCUMENTS

| | | | | | |
|---|---|---|---|---|---|
| 3,828,467 | A | | 8/1974 | Kaelin | |
| 4,225,169 | A | | 9/1980 | DeToma | |
| 4,244,138 | A | | 1/1981 | Holahan et al. | |
| 4,268,918 | A | | 5/1981 | Lee | |
| 4,298,199 | A | | 11/1981 | Bush et al. | |
| 4,476,650 | A | | 10/1984 | Lokvig | |
| 4,571,206 | A | * | 2/1986 | Mayer et al. | 446/330 |
| 4,575,349 | A | | 3/1986 | Piazza et al. | |
| 4,685,893 | A | | 8/1987 | Perkitny et al. | |
| 4,867,729 | A | * | 9/1989 | Weinman et al. | 446/330 |
| 4,910,647 | A | * | 3/1990 | Gong | 362/122 |
| 4,995,661 | A | | 2/1991 | Aurness et al. | |
| 5,090,569 | A | * | 2/1992 | Nissen et al. | 206/457 |
| 5,167,562 | A | | 12/1992 | Axtell | |
| 5,378,188 | A | * | 1/1995 | Clark | 446/330 |
| 5,522,758 | A | * | 6/1996 | Liu et al. | 446/310 |
| 5,588,895 | A | | 12/1996 | Larson | |
| 5,624,320 | A | * | 4/1997 | Martinez | 472/51 |
| 5,803,787 | A | | 9/1998 | Kulchyski | |
| 5,924,175 | A | | 7/1999 | Lippitt et al. | |
| 5,946,835 | A | * | 9/1999 | Boyd | 40/412 |
| 5,964,638 | A | | 10/1999 | Emerson | |
| 6,012,962 | A | * | 1/2000 | Arriola | 446/376 |
| 6,152,799 | A | | 11/2000 | Arriola | |
| 6,200,190 | B1 | | 3/2001 | Reynolds | |
| 6,389,718 | B1 | * | 5/2002 | Joo | 40/439 |
| 6,419,541 | B1 | | 7/2002 | Apichom | |
| 6,574,915 | B1 | | 6/2003 | Allen | |
| 7,175,497 | B2 | | 2/2007 | Herzog | |
| 7,318,766 | B2 | * | 1/2008 | Marine et al. | 446/359 |
| 7,338,342 | B2 | | 3/2008 | Bellon | |
| 7,842,359 | B2 | * | 11/2010 | Marlow | 428/24 |
| 7,861,444 | B2 | * | 1/2011 | Marlow | 40/411 |
| 2004/0056492 | A1 | | 3/2004 | Traber | |
| 2004/0080169 | A1 | | 4/2004 | Khubani et al. | |
| 2004/0135387 | A1 | | 7/2004 | Keith et al. | |
| 2004/0145196 | A1 | | 7/2004 | Katz | |
| 2005/0057055 | A1 | | 3/2005 | Deal | |
| 2005/0184540 | A1 | | 8/2005 | Graziosi | |
| 2005/0191935 | A1 | | 9/2005 | Marine et al. | |
| 2006/0160466 | A1 | | 7/2006 | Bellon | |
| 2006/0172652 | A1 | | 8/2006 | Herzog | |
| 2008/0042456 | A1 | | 2/2008 | Patel | |

FOREIGN PATENT DOCUMENTS

| | | |
|---|---|---|
| WO | 9318831 | 9/1993 |

OTHER PUBLICATIONS

The International Search Report from corresponding International Application Serial No. PC/US2009/041285, mailed on Jun. 16, 2009.

* cited by examiner

DOLLS AND DOLL STANDS

CROSS-REFERENCES

The present application claims priority to provisional patent application Ser. No. 61/125,081. titled "DOLLS AND DOLL STANDS WITH SELECTIVELY ACTUABLE COMPONENTS," filed Apr. 21, 2008, the disclosure of which is incorporated herein by reference for all purposes.

BACKGROUND

The present disclosure is directed generally to interactive doll stands and, more particularly, to display devices to which dolls may be mounted, where the dolls and/or the display devices include one or more associated movable components that may be selectively actuated so as to substantially enclose the doll within the display device. Examples of interactive doll stands and devices with selectively actuable components are disclosed in U.S. Pat. Nos. 2,990,668, 4,298,199, 4,995,661, 6,874,833, 7,004,520, and 7,318,766. The disclosures of all the above-referenced patents are incorporated herein by reference in their entirety for all purposes.

SUMMARY

A toy product including a doll and a display device that may be used with the doll or other similarly configured character or persona is provided. The doll may have one or more movable features and may further include wings detachably coupled to the doll. An actuating assembly of the display device may communicate through one or more selectively actuable components with one or more movable features of the doll.

The actuating assembly may be operatively connected to a folding assembly that may alternately enclose and reveal the doll releasably mounted to the display device. The folding assembly may include one or more enclosure pieces that, in some embodiments, may be in the form of flower petals and may fold over the doll so as to form an enclosure and, thereby, substantially surround the doll. Each enclosure piece may have a sleeved portion configured to matingly receive a corresponding flexible member adapted to bend between an extended and retracted position in response to the operation of the actuating assembly. The bending of the flexible members may be facilitated by linkage elements operatively connecting the actuating assembly with each flexible member.

The actuating assembly may include an actuator and a locking member configured to releasably retain the folding assembly in the retracted position. The actuator may be partially or substantially housed within the display device and may be configured for transmitting a motion of the actuator to a reverse-blooming motion of the folding assembly.

In some embodiments, the actuating assembly may be actuated by manually pushing the actuator in the direction of actuation. The actuator may operatively engage and simultaneously pull the linkage elements so the flexible members and associated enclosure pieces move from the extended toward the retracted position. In the embodiments in which the enclosure pieces resemble flower petals, such movement of the pieces may have the effect of a flower closing up to surround the doll.

The flexible members and associated enclosure pieces may be releasably retained in the retracted position by way of a locking member, such as by releasably locking the actuator when the enclosure pieces are in the retracted position. The actuating assembly may further include a push-button that may be configured to release the actuator and return the flexible members and associated enclosure pieces to the extended position. As a result, the folding assembly may unfold, thus, revealing the doll mounted to the display device. In the embodiments in which the enclosure pieces resemble flower petals, such unfolding may have the effect of a flower bloom opening up.

The actuating assembly may further include a lifting member that may partially or substantially support one or more movable features of the doll. The lifting member may be operatively connected to the actuating assembly and may be configured so as to concomitantly lift or, otherwise, move one or more features of the doll as the enclosure pieces surround the doll. Thus, the lifting member may further facilitate enclosure of the doll within the display device.

The dolls and display devices of the present disclosure may be understood more readily after a consideration of the drawings and the Detailed Description.

DETAILED DESCRIPTION

Figure 1:
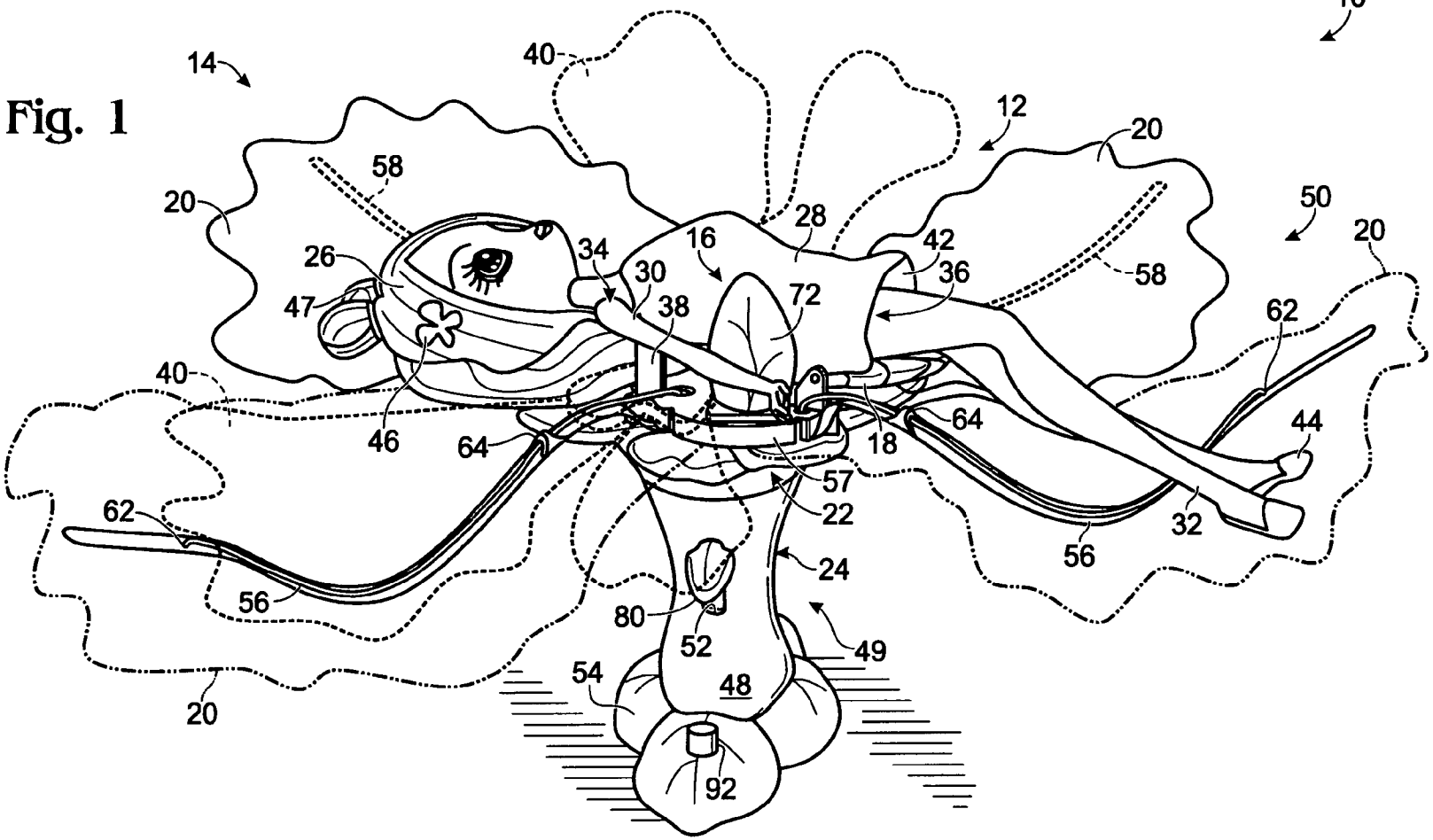
FIG. 1 is a perspective view of a toy product including a doll mounted on a display device, showing enclosure pieces of the display device in an extended position.
Figure 2:
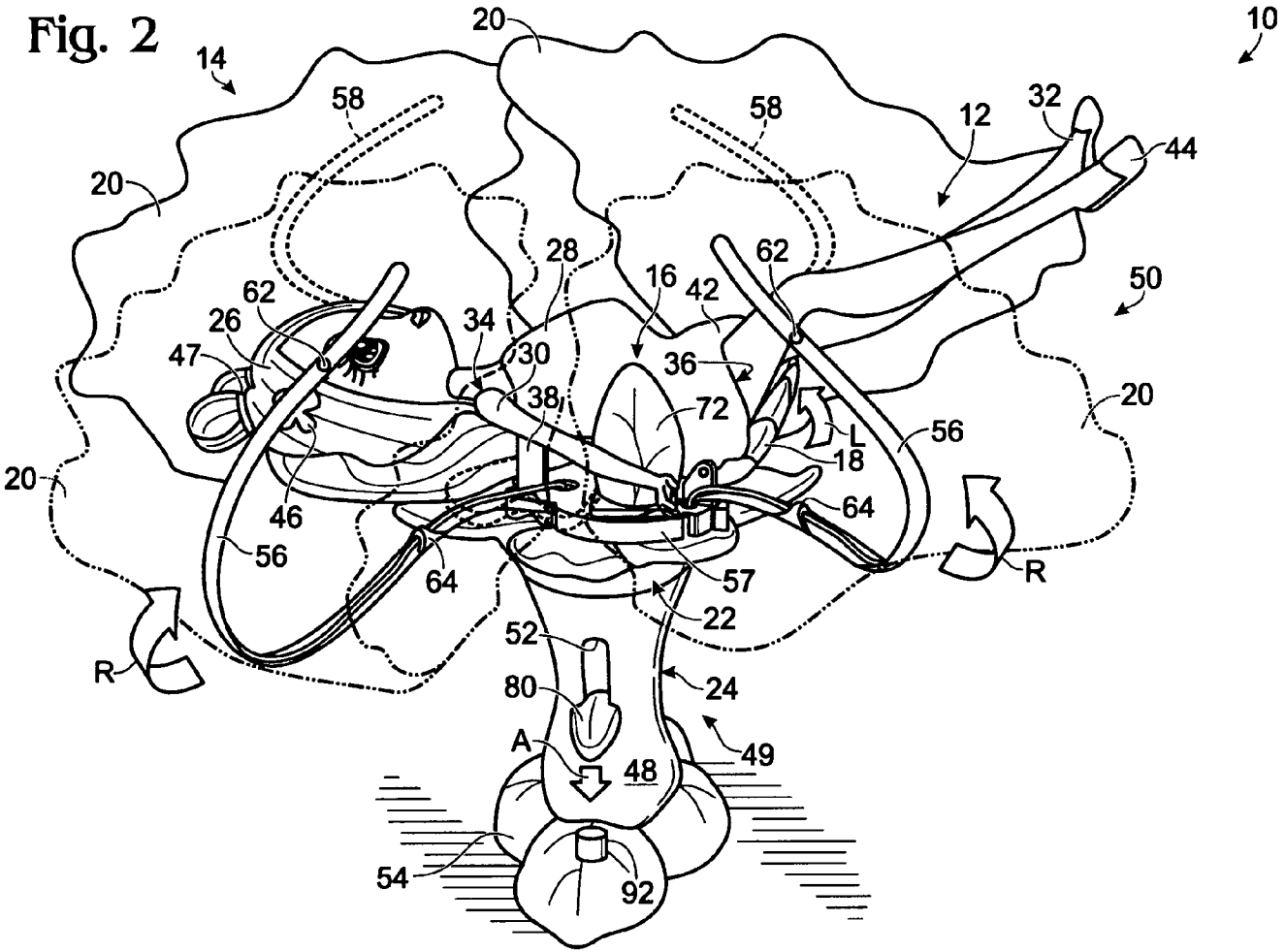
FIG. 2 is a perspective view of the toy product of FIG. 1 showing the enclosure pieces in a retracted position.

FIGS. 1-2 illustrate examples of a toy product 10 including a doll 12 and a display device 14. Doll 12 may be releasably retained within a mounting structure 16 and may be substantially or partially supported by a leaf-shaped lever or lifting member 18, as will be described in greater detail below. In the example shown, a plurality of enclosure pieces 20 may extend outwardly from an upper portion 22 of the display device and may resemble flower petals.

As seen in FIG. 2, enclosure pieces 20 may be moved to a retracted position, as indicated by arrows R, in response to operation of an actuating assembly 24 and may substantially enclose doll 12 within display device 14. As will be seen, lifting member 18 may further facilitate such enclosure by concomitantly lifting or otherwise moving one or more movable features of doll 12. It will be noted that terms of orientation used in the description apply when toy product 10 is in an operative position on a substantially horizontal surface, as shown in FIGS. 1-2. When toy product 10 is in other orientations, these terms provide relative meaning, even though not literally accurate.

Toy product 10 may represent or further a particular theme and/or simulate a fictional or non-fictional story, as well as a traditional fairy tale. In the embodiments in which enclosure pieces 20 resemble flower petals, the movement of the enclosure pieces may have the effect of a flower closing up to surround the doll. As such, doll 14 may be perceived as a humanoid, such as a winged fairy, that lives in a flower that blooms and closes, as desired, to house or shelter the doll. Optionally or alternatively, toy product 10 may have no theme.

It should be appreciated that even though a plurality of flower-like petals is illustrated, enclosure pieces 20 may have any desired shape of form, and that display device 14 may include a single enclosure piece configured to substantially enclose doll 12, when in the retracted position of FIG. 2.

Doll 12 may be configured to represent a human-like character, licensed character, copyrighted character, or any other suitable fantasy or real-life character, as mentioned above. To simplify discussion, features of toy product 10 shown in FIGS. 1-2 that correspond to features of the examples illustrated in FIGS. 3-8 are given the same reference numbers.

Still referring to FIGS. 1-2, doll 12 may include, as major features, a head 26, a torso 28, arms 30, and legs 32 movably attached to respective shoulder and hip joints 34 and 36. Head 26 may be configured to be movable in any direction relative to torso 28 and may include human-like features with makeup and fashionable hair. Shoulder joints 34 and hip joints 36 of doll 12 may be configured so as to allow a wide degree of pivoting relative to torso 28.

Arms 30 may be movably secured to torso 28 in any conventional manner. In the configuration shown, arms 30 may be frictionally fit within shoulder joints 34 allowing each arm to pivot independently about the shoulder joints so as to enable posing of each arm at a variety of pivotal positions. Optionally or alternatively, arms 30 may be rigidly connected together via a shared arm connector for simultaneous rotation relative to torso 28 along a common substantially horizontal axis.

Legs 32 may be rotatably attached to a lower portion of torso 28 at hip joints 36 to enable for a wide degree of independent pivoting about a substantially horizontal axis. Under some circumstances, however, it may be preferable to limit the relative rotational movement of legs 32 at the respective hip joints of doll 12. Optionally or alternatively, legs 32 may be rigidly connected to each other via a shared leg connector for simultaneous rotation relative to torso 28. In addition, appropriate stoppers may be provided to effectively prevent the legs from being pivoted beyond prescribed points and/or to allow for a desired clearance with enclosure pieces 20 or other elements or members of display device 14.

Figure 3:
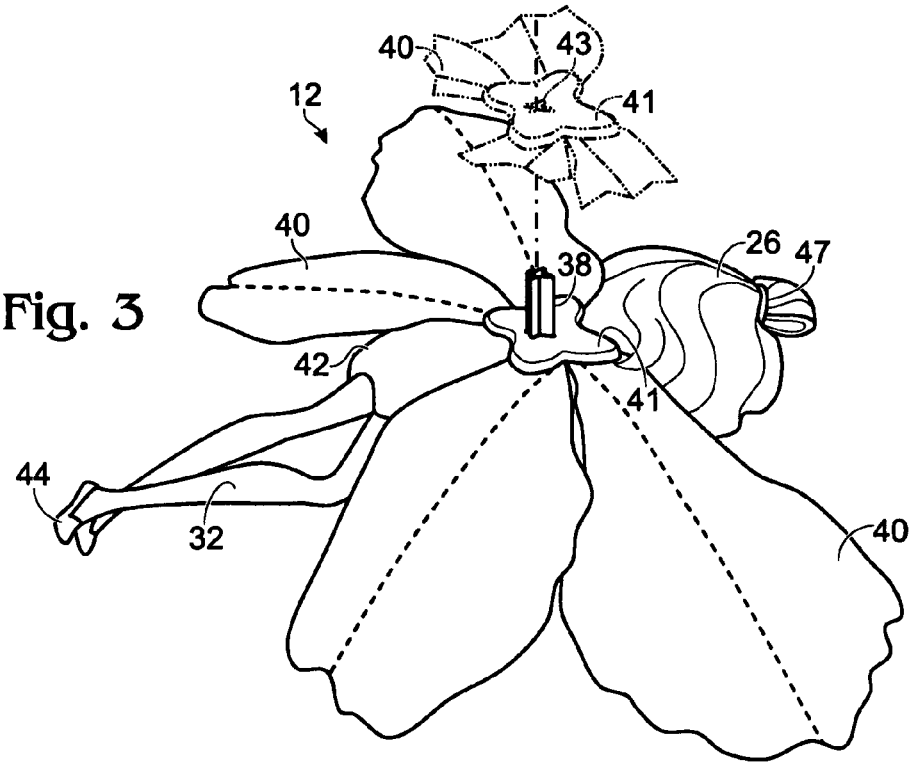
FIG. 3 is a rear elevation view of the doll of FIGS. 1-2 illustrating wings detachably coupled to the doll.

As viewed more readily in FIG. 3, doll 12 may further include a pin or projection, such as, for example, an elongate projection 38 protruding outwardly from the back portion of the doll for releasably securing the doll within display device 14, as will be seen. In the present example, doll 12 is shown to further include wings 40 that may be shaped like butterfly wings and may be fixedly secured to a support plate 41 by appropriate means, such as, for example, thread, screws, bolts, nuts, clamps, clips, glue, and so forth. Wings 40 may comprise of one or more layers of flexible material or, alternatively, may include a flexible skeleton over which one or more layers of flexible material may be mounted to retain a particular shape of the wings.

Support plate 41 may include an aperture 43 that may be non-circular in cross-section and may correspond to the cross-section of elongate projection 38. Wings 40 may be detachably coupled to doll 12 by inserting elongate projection 38 into aperture 43 when the aperture and the projection are aligned, as shown in the dash-dotted line. The non-circular nature of both cross-sections may limit rotational movement of wings 40 relative to doll 12. Optionally or alternatively, wings 40 may not be detachable from doll 12.

As mentioned above with reference to FIGS. 1-2, doll 12 may additionally include a decorative bodice or dress 42, a pair of shoes 44, and one or more accessories to further a particular theme, as previously mentioned. For purposes of illustration, the accessories are shown to include a hair clip 46 and a hair band 47. While only a certain number of accessories in reference to the particular theme are illustrated in this example, doll 12 may include any number of accessories or no accessories, and any such accessories may be positioned anywhere within and/or next to doll 12. In addition, the dress, shoes, and/or accessories may or may not be removable from doll 12.

The various components of doll 12 may be fabricated from any suitable material, such as plastic, foamed plastic, flexible plastic, one or more layers of fabric, wood, cardboard, pressed paper, metal, or any combination of materials. A suitable material or combination of materials may be selected to provide a desirable synergy of weight, strength, durability, cost, and/or manufacturability.

Display device 14 may include actuating assembly 24 that may be partially or substantially housed within a base 48 and a folding assembly 50 supported by upper portion 22 of the base. In the configuration shown, base 48 may further include a lower portion 49 having a generally vertical tubular body. One or more contoured slotted openings 52 may be positioned on opposite sides of lower portion 49 to facilitate an actuation of actuating assembly 24, as will be described in greater detail below. As seen, display device 14 may be configured as a free-standing structure, and lower portion 49 of base 48, thus, may further include a flattened platform, such as a leaf-shaped platform 54, to stabilize the device in a standing position on a substantially horizontal surface.

Figure 5:
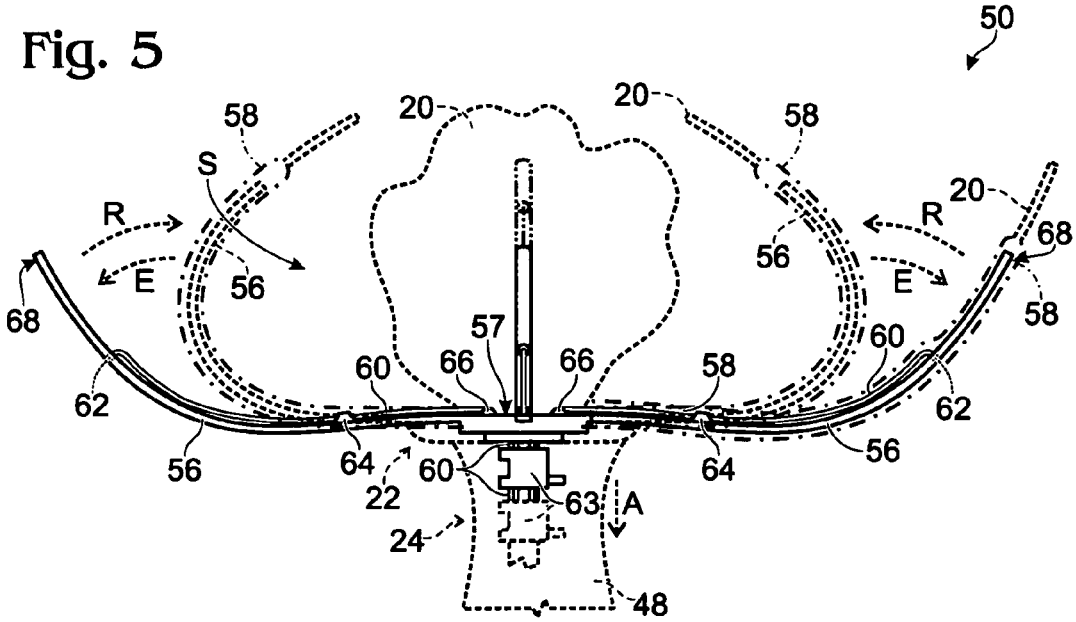
FIG. 5 is a schematic side elevation view of the folding assembly of FIG. 4 illustrating extension and retraction of the folding assembly in response to operation of an actuating assembly.
Figure 4:
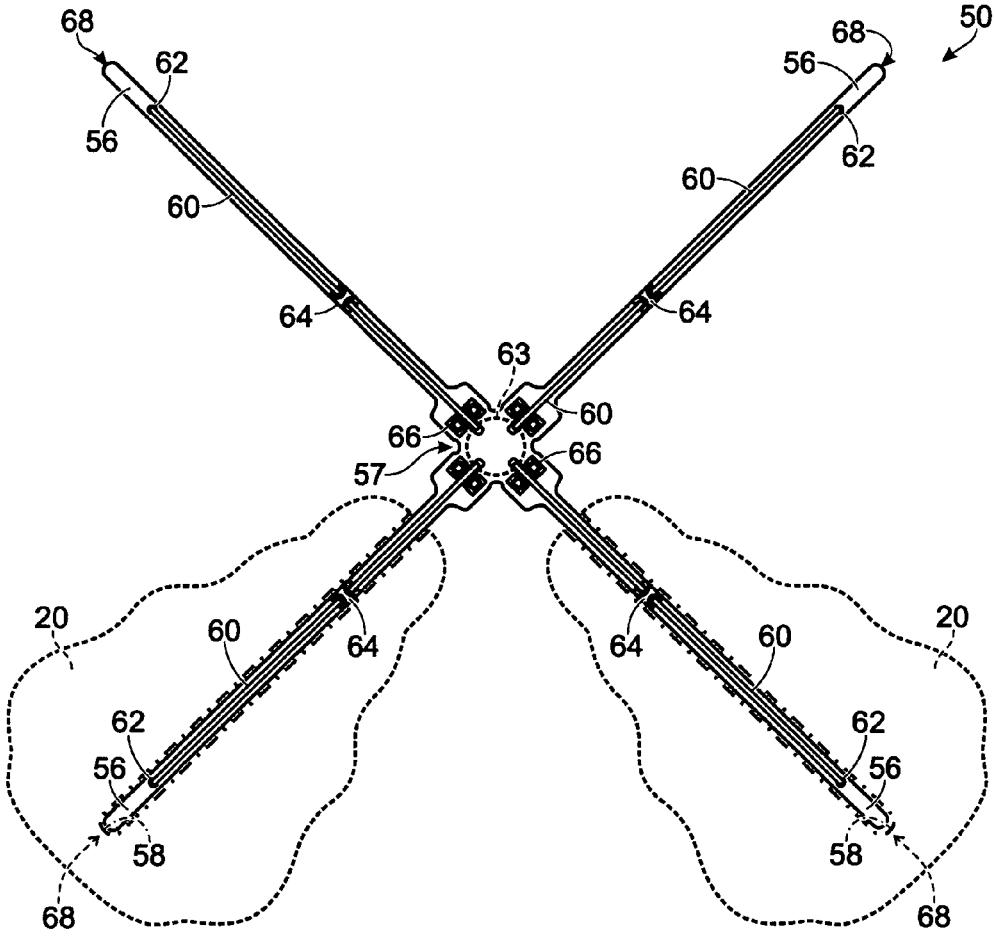
FIG. 4 is a simplified top view of a folding assembly of the display device of FIGS. 1-2.

FIG. 4 is a top view of folding assembly 50 in the extended position, and FIG. 5 illustrates the folding assembly moving between the extended and retracted positions. In the configuration shown, folding assembly 50 may include a plurality of enclosure pieces, indicated generally in dashed lines at 20, and a plurality of corresponding elongate flexible members 56 extending outwardly from a shaped platform 57. For purposes of illustration, folding assembly 50 is shown schematically with one or more enclosure pieces 20 omitted. The principles discussed with reference to the folding assembly with multiple enclosure pieces in FIGS. 4-5 are applicable to other embodiments of folding assemblies, such as, for example, assemblies with a single enclosure piece.

In the present example, each enclosure piece 20 may be fabricated from one or more layers of a soft material, such as fabric and/or flexible plastic, and may include a pocket or sleeved portion 58, indicated in dash-dotted lines, adapted to matingly receive corresponding flexible member 56 in a tightly-fitted relationship. It should be noted that flexible members 56 may be sufficiently resilient so as to facilitate moving of folding assembly 50 from the retracted position indicated by arrow R in FIG. 5 to the extended position of FIG. 4 upon disengagement of actuating assembly 24, as will be described below.

Folding assembly 50 may further include one or more linkage elements 60 that may be fixedly secured to a respective coupling element 62 and may operatively connect folding assembly 50 with actuating assembly 24 via a hub 63, as particularly seen in the example of FIG. 5. Linkage elements 60 may be affixed to hub 63 by appropriate means.

Linkage elements 60 may partially or substantially extend along the length of corresponding flexible member 56 and may be slidably engaged within a wedge-shaped retaining element 64. Retaining elements 64 may be provided with one or more apertures and may be configured to have any desired shape and/or cross-section to further their particular function. In addition, folding assembly 50 may include one or more guides 66 to maintain linkage elements 60 in a predetermined orientation relative to flexible members 56.

As shown in FIG. 5, flexible members 56 may be slightly bowed and/or biased, when in the extended position, so as to enable bending of the members in a particular direction, such as, for example, in a retracting direction indicated by arrow R. Such bowing and/or biasing may be facilitated by sufficient resilient properties of flexible members 56 and/or by appropriate lengths of respective linkage elements 60 urging distal ends 68 of the corresponding flexible members upwardly and/or inwardly.

In operative use, actuating assembly 24 may engage hub 63 and, thus, simultaneously draw linkage elements 60 in the direction of actuation, schematically represented by arrow A. In turn, linkage elements 60, slidably guided through respective retaining elements 64 and tightly-fit sleeved portions 58, may engage respective coupling elements 62 to draw and to forceably bend associated flexible members 56 toward the retracted position, as indicated by arrow R. Upon disengagement, flexible members 56 may return to the extended position, as represented by arrow E, using the resilient properties of the members, or by way of gravity, or both. Optionally or alternatively, actuating assembly 24 may include a resilient member that may facilitate the return of flexible members 56 to the extended position, as will be seen.

As illustrated, retaining elements 64 may be configured to remain in substantially the same orientation relative to base 48 when flexible members 56 move—and associated enclosure pieces 20 follow—from the extended to the retracted position so as to create a substantially enclosed space S sufficient to surround doll 12. This effect may be accomplished by placing retaining elements 64 on the associated flexible members at a desired distance from platform 57 and by a closely-spaced cooperating relationship between linkage elements 60, flexible members 56, and associated sleeved portions 58. It should be appreciated that in some embodiments retaining elements 64 may be positioned closer or further away from platform 57 so as to create a smaller or larger space, respectively, depending on the size of doll 12.

Figure 6:
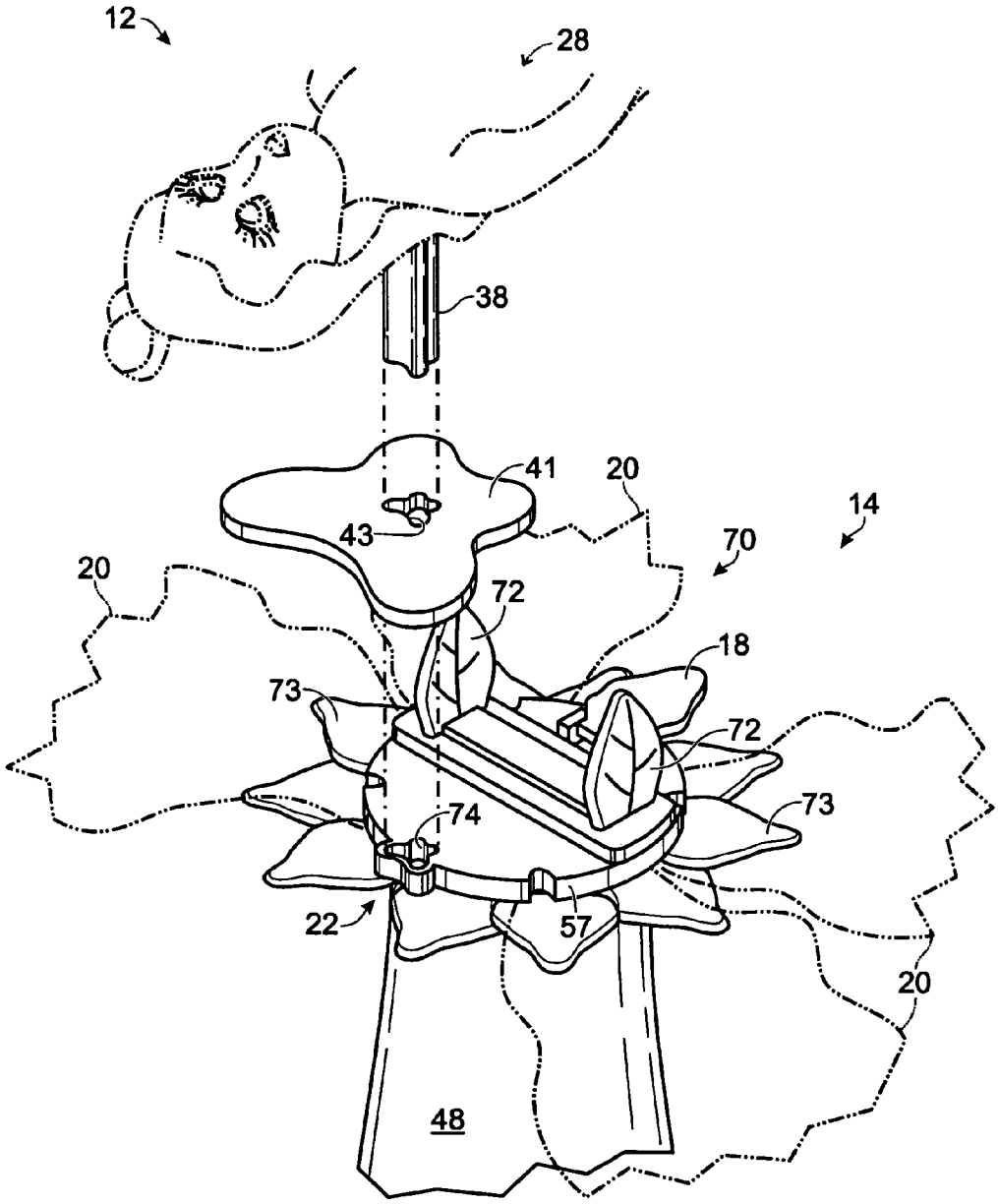
FIG. 6 is a simplified perspective view of a mounting structure of the display device of FIGS. 1-2.

FIG. 6 illustrates an exemplary embodiment of a mounting structure 70 that may be supported by upper portion 22 of base 48 and may be used to releasably retain doll 12 within display device 14. The doll's wings are not shown to make the parts therebehind visible.

As seen in this example, mounting structure 70 may include a plurality of leaf-shaped bracing members 72 that may have a slightly curved or arcuate shape and may extend upwardly from platform 57. Bracing members 72 may be rigidly connected to the platform by appropriate means and may be spaced apart so as to frictionally retain torso 28 of doll 12 therebetween. As a way of illustration, platform 57 is shown to include a plurality of leaf-shaped elements 73 designed to further the theme of toy product 10. Optionally or alternatively, platform 57 may have no theme-oriented design.

An irregularly-shaped aperture 74 may be formed within the upper portion of platform 57 and may have a non-circular cross-section that may correspond to cross-sections of elongate projection 38 of doll 12 and aperture 43 in support plate 41. In assembled relationship, elongate projection 38 may be aligned with, as shown in dash-dotted lines, and may project through aperture 43 in support plate 41 so as to be matingly positioned within aperture 74, thus, effectively linking doll 12 and display device 14 together. The non-circular nature of the cross-sections may help with self-alignment of doll 12 within display device 14 so as to facilitate correct positioning of the doll's legs on lifting member 18, as will be seen.

Figure 7:
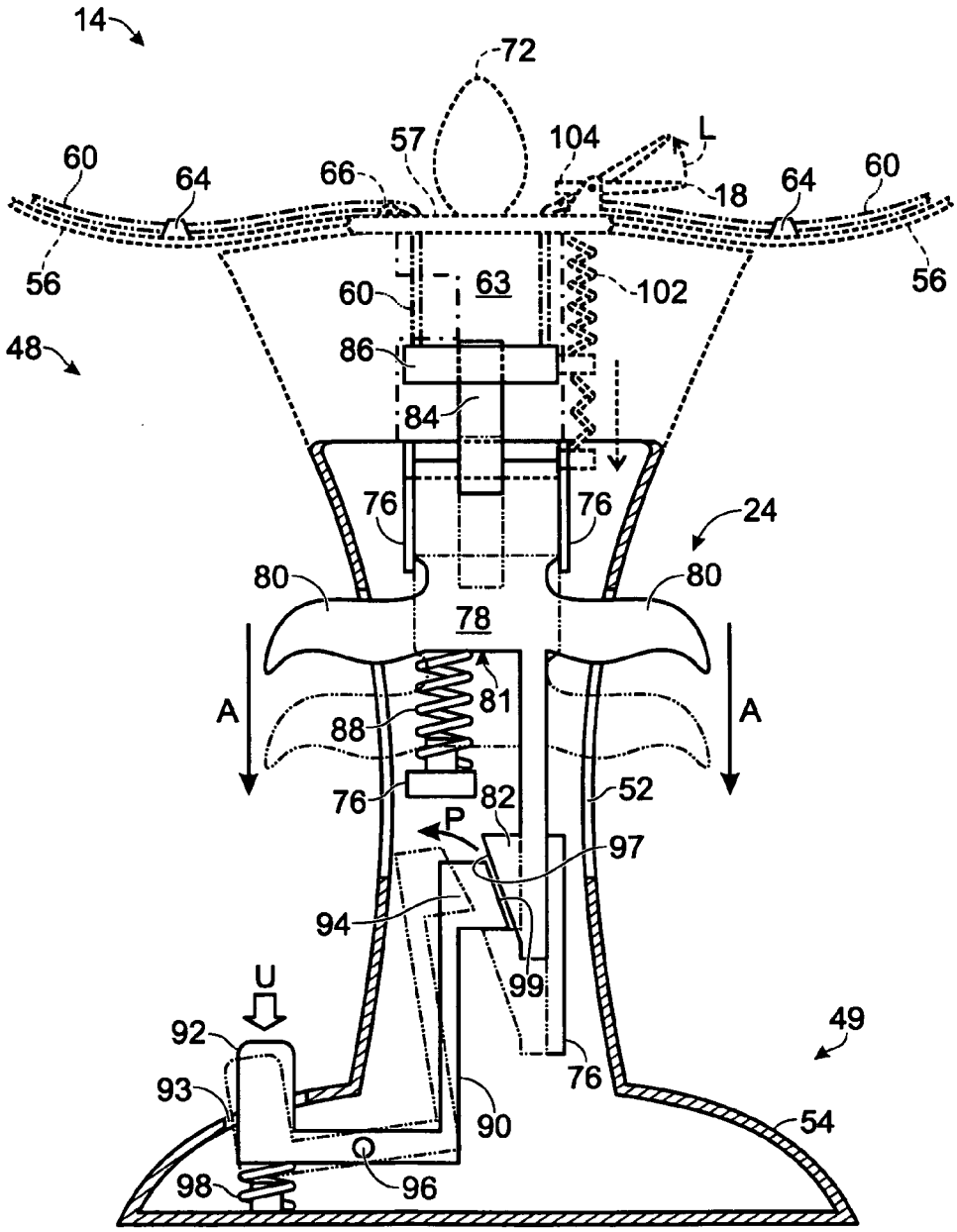
FIG. 7 is a simplified cut-away view of the actuating assembly of the display device of FIGS. 1-2.

FIG. 7 is a simplified cut-away view of actuating assembly 24 associated with display device 14 of FIGS. 1-2. In the configuration shown, actuating assembly 24 may be partially or substantially housed within base 48 and may be secured by means of an inner support structure formed by a plurality of rigid support members 76.

Actuating assembly 24 may include an actuator, such as a cross-shaped actuator 78 with one or more leaf-shaped actuator handles 80 projecting outwardly through associated slotted openings 52 in lower portion 49 of base 48, as has been previously mentioned. Actuator 78 may be slidably retained within inner support members 76 to allow for a linear reciprocal motion and may further include a shoulder portion 81 and an angled locking portion 82. As will be seen, actuating assembly 24 may be configured for transmitting a motion of actuator 78 to a reverse-blooming motion of folding assembly 50.

In the configuration shown, a T-shaped end portion 84 of actuator 78 may operatively connect the actuator to folding assembly 50 via hub 63 by way of one or more inserts 86. A resilient member, such as, for example, a compression spring 88 may be interposed between shoulder portion 81 of the actuator and inner support member 76 so as to bias actuator 78 upwardly.

Actuating assembly 24 may further include a locking member 90 with an integrally-formed push-button 92 protruding outwardly through an aperture 93 in platform 54, and an angled tooth 94 adapted to engage and retain locking portion 82 of actuator 78. Locking member 90 may be pivotally secured within platform 54 with a pin 96 so as to allow the limited amount of pivoting and may be biased upwardly by a compression spring 98. It should be appreciated that any other resilient means may be used to bias push-button 92, as well as actuator 78, in suitable directions to further their particular functions.

In the present example, tooth 94 and locking portion 82 may include angled regions 97 and 99, respectively. The angled regions may be configured such that a downward motion of actuator 78, represented by arrow A, may bring the regions in contact, and may impart a forced pivoting of locking member 90 in the direction indicated by arrow P.

As previously discussed, actuating assembly 24 may further include lifting member 18 that may be pivotally secured to platform 57 by means of a fulcrum pin 100 so as to allow for a wide degree of pivoting about a substantially horizontal axis. Lifting member 18 may be operatively linked to actuator 78 by way of a tension spring 102 fixedly secured with one end to hub 63 and with another end to an effort arm 104 of lifting member 18. It should be noted that any other appropriate means may be used to operatively connect lifting member 18 with actuator 78.

During play, the actuation of actuating assembly 24 may cause the reverse blooming motion of folding assembly 50 and may substantially enclose doll 12 within display device 14. In the present example, actuating assembly 24 may be actuated by manually pushing handles 80 of actuator 78 in the direction of actuation, as indicated by arrow A. T-shaped end portion 84 of actuator 78 and, more specifically, inserts 86 may engage hub 63 to travel downward.

Since hub 63 is operatively connected to flexible members 56 by linkage elements 60, the hub may simultaneously draw the linkage elements so as to bend flexible members 56 and associated enclosure pieces 20 of folding assembly 50 toward the retracted position, as has been described with reference to FIG. 5. It should be appreciated that any other systems or configurations may be used to actuate actuating assembly 24.

As actuator 78 travels downward, angled region 97 may contact and exert force against angled region 99, thus, forcing locking member 90 to pivot about the axis of pin 96 against the biasing action of spring 98 in the counter-clockwise direction, as indicated by arrow P. Forced pivoting of locking member 90 may continue until actuator 78, in its downward movement, passes a predetermined point, such as, for example, when angled region 97 completely passes angled region 99 of locking member 90. As this occurs, locking member 90 may pivotally snap back in the clockwise direction due to the biasing action of spring 98 so as to engage locking portion 82 and, thus, retain actuator 78 in a lowered or locked position by tooth 94.

Folding assembly 50, thus, may be retained in the retracted position, as shown in FIGS. 2 and 5, by the interconnection of actuator 78 with flexible members 56 via linkage elements 60, as described above. It should be appreciated that other internal lock mechanisms may be used to releasably retain folding assembly 50 in the retracted position.

Exerting sufficient force on push-button 92, as indicated by arrow U, may disengage locking member 90 and may return folding assembly 50 to the extended position, as shown in FIGS. 1 and 4. When button 92 is depressed, locking member 90 may pivot in the counter-clockwise direction P and may cause tooth 94 to slip out of locking portion 82. This may effectively release actuator 78, and spring 88 may urge the actuator to travel upward, thus, loosening the tension of linkage elements 60 and returning folding assembly 50 to the extended position. As a result, folding assembly 50 may unfold, thus, revealing doll 12 mounted to display device 14. In the embodiments in which the enclosure pieces resemble flower petals, such unfolding may have the effect of a flower bloom opening up.

Figure 8:
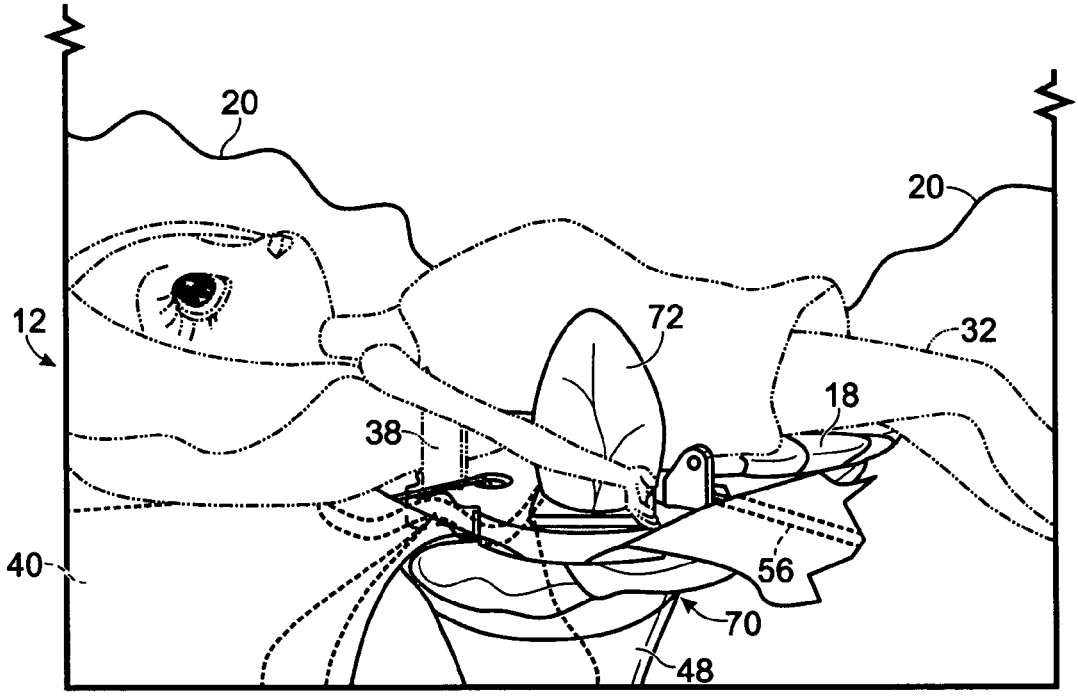
FIG. 8 is a simplified perspective view of the mounting structure of FIG. 6 illustrating a lifting member associated with the actuating assembly of FIG. 7.
Figure 9:
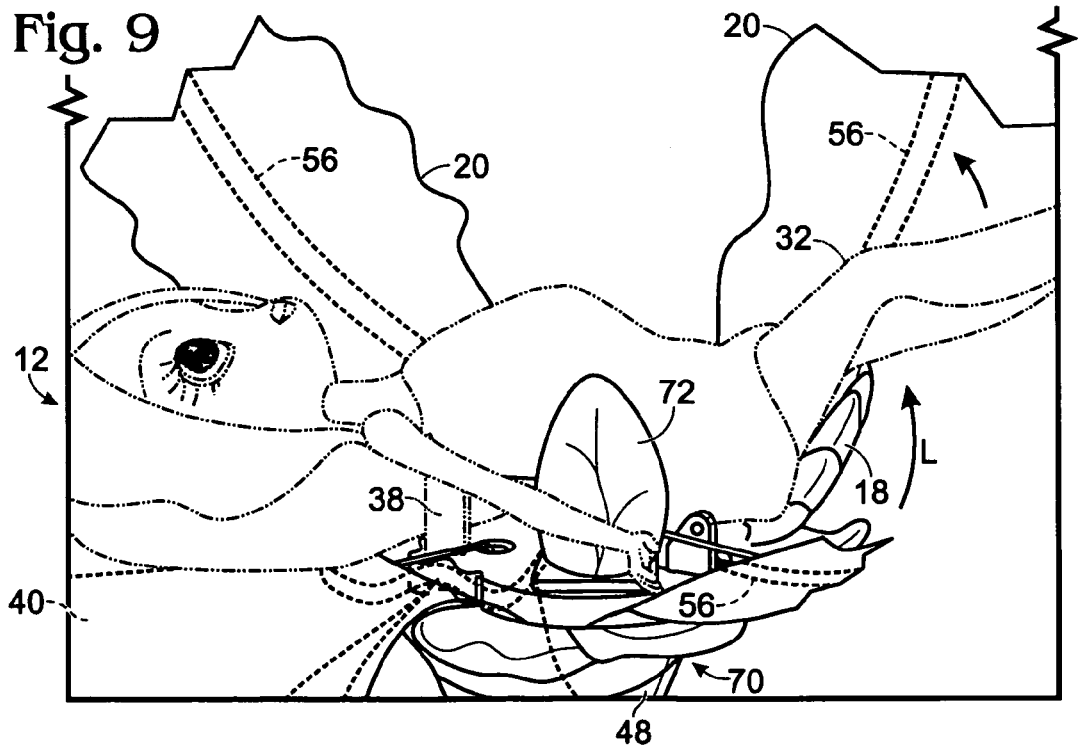
FIG. 9 is a simplified perspective view of the mounting structure of FIG. 6 illustrating the lifting member of FIG. 8 moving the doll's legs upwardly to a folded position upon actuation of the actuating assembly.

As further seen in the examples of FIGS. 8-9, when doll 12 is releasably retained or otherwise stationary positioned within mounting structure 70, legs 32 of the doll may be partially or substantially supported by lifting member 18. Because actuator 78 is operatively linked to lifting member 18, as described with reference to FIG. 7, the force exerted on spring 102 by downward motion of the actuator may cause the lifting member to pivot about fulcrum pin 100, as indicated by arrow L. Therefore, as actuator 78 moves folding assembly 50 toward the retracted position, lifting member 18 may concomitantly move legs 32 of doll 12 upwardly to a folded position, as illustrated in FIG. 9. Lifting member 18, thus, may further facilitate sufficient enclosure of doll 12 within display device 14.

While embodiments of a toy and methods of toy play have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A toy display device, comprising:

a base;

a folding assembly supported by the base, the folding assembly comprising:

a flexible member extending from the base, the flexible member having a distal end, a retaining element, and a coupling element disposed between the retaining element and the distal end, the flexible member being adapted to bend between an extended position and a retracted position;

an enclosure piece supported by the flexible member and including a sleeved portion adapted to receive the flexible member;

a linkage element extending from the base along the flexible member, wherein the linkage element slidably engages the retaining element and is secured to the coupling element;

an actuating assembly supported by the base, wherein the actuating assembly is configured, upon actuation, to:

draw the linkage element toward the base, thereby bending the flexible member from the extended position to the retracted position.

2. The display device of claim 1, wherein the retaining element includes at least one opening through which the linkage element extends.

3. The display device of claim 1, wherein the coupling element moves toward the base, and the retaining element remains in substantially the same position relative to the base, upon actuation of the actuating assembly.

4. The display device of claim 1, wherein the actuating assembly includes a guide configured to align the linkage element in a predetermined orientation relative to the flexible member.

5. The display device of claim 1, wherein the actuating assembly includes a locking member configured to releasably retain the flexible member in the retracted position.

6. The display device of claim 5, wherein the locking member is configured to releasably retain the linkage element after the linkage element has been drawn toward the base.

7. The display device of claim 1, wherein the enclosure piece is configured to form a substantially enclosed space when the flexible member is in the retracted position.

8. The display device of claim 1, wherein the base includes a mounting structure configured to releasably receive the toy.

9. The display device of claim 1, wherein the actuating assembly further includes an actuator movably connected to the base, at least a portion of the actuator positioned to be accessible from external the display device, the actuator being configured, when moved, to draw the linkage element toward the base.

10. A toy display device, comprising:

a base;

a folding assembly supported by the base, the folding assembly comprising:

a flexible member extending from the base, the flexible member having a distal end, a retaining element, and a coupling element disposed between the retaining element and the distal end, the flexible member being adapted to bend between an extended position and a retracted position;

a linkage element extending from the base along the flexible member, wherein the linkage element slidably engages the retaining element and is secured to the coupling element;

an enclosure piece supported by the flexible member, wherein the enclosure piece includes a sleeved portion adapted to receive the flexible member and is configured to form a substantially enclosed space when the flexible member is in the retracted position; and an actuating assembly supported by the base, wherein the actuating assembly is configured, upon actuation, to draw the linkage element toward the base, thereby bending the flexible member from the extended position to the retracted position.

11. A toy product, comprising:

a doll;

a display device configured to detachably retain the doll, the display device further comprising:

a base;

a folding assembly, comprising:

a flexible member extending from the base and having a distal end;

an enclosure piece supported by the flexible member and having a sleeved portion adapted to receive the flexible member; and a linkage element extending from the base along the flexible member, wherein the linkage element is secured to the flexible member at a point between the base and the distal end of the flexible member;

an actuating assembly supported by the base, wherein the actuating assembly is operable, upon actuation, to draw the linkage element toward the base, thereby bending the flexible member from the extended position toward the retracted position; and wherein the enclosure piece substantially enclose the doll when the flexible member is in the retracted position.

12. The toy product of claim 11, wherein the doll includes one or more movable features.

13. The toy product of claim 11, wherein the doll includes an elongate projection protruding from the doll, and wherein the display device includes a corresponding aperture configured to receive the elongate projection.

14. The toy product of claim 11, wherein the display device further includes a mounting structure having one or more bracing members extending from and supported by the base and configured to releasably receive the doll.

15. The toy product of claim 11, wherein the actuating assembly includes a lifting member supported by the base, the lifting member being operatively connected to the actuating assembly and configured for movement relative to the base.

16. The toy product of claim 15, wherein the doll includes at least one moveable feature, and the lifting member is adapted to move the at least one movable feature upon actuation of the actuating assembly.

17. The toy product of claim 15, wherein the doll includes at least one moveable feature, and the lifting member moves the at least one movable feature upon actuation of the actuating assembly, such that the at least one movable feature is enclosed within the enclosure piece.

18. A toy product, comprising:

a doll with movable human features having an elongate projection disposed on the doll and a pair of wings detachably coupled to the doll via the elongate projection;

a display device configured to detachably retain the doll, the display device further comprising:

a base having an upper portion, a lower portion, and an aperture within the upper portion, the aperture being configured to matingly receive the elongate projection to detachably couple the doll to the display device;

a folding assembly, comprising:

a plurality of elongate flexible members extending from the upper portion of the base, each configured to bend between an extended position and a retracted position, and each including a distal end, a retaining element, and a coupling element disposed therebetween;

a corresponding plurality of enclosure pieces, each enclosure piece having a sleeved portion configured to receive each flexible member;

a corresponding plurality of linkage elements extending from the upper portion of the base along each flexible member, wherein each linkage element slidably engages each retaining element and is secured to the coupling element of each flexible member;

an actuating assembly supported by the base, wherein the actuating assembly is operable upon actuation to draw the plurality of linkage elements towards the base, thereby bending each flexible member from the extended position toward the retracted position, and wherein such bending urges each distal end of each flexible member towards the base in a manner that creates a substantially enclosed space around the doll defined by the enclosure pieces.

19. The toy product of claim 18, wherein the display device further includes a mounting structure supported by the upper portion of the base, the mounting structure having bracing members configured to receive and releasably retain the doll therebetween.

20. The toy product of claim 18, wherein the base further includes a lever pivotally connected to the upper portion of the base, the lever being operatively coupled with the actuating assembly and configured, upon actuation, to:

move one or more movable human features to a folded position, wherein such movement is concomitant with actuation of the actuating assembly, and wherein the movable human features in the folded position are enclosed within the enclosure pieces.

21. The toy product of claim 18, wherein the actuating assembly further includes a locking system supported by the base, wherein the locking system is configured to:

engage the actuating assembly when the actuating assembly passes a predetermined point, such that each flexible member is releasably retained in the retracted position; and return each flexible member into the extended position upon disengagement.

* * * * *